US005997297A

United States Patent [19]

Coburn et al.

[11] Patent Number: 5,997,297

[45] Date of Patent: Dec. 7, 1999

[54] METHOD OF MOUNTING TOOL USED IN DENTISTRY

[76] Inventors: Andrew Coburn, 78 Creighton Road, Dundas, Ontario, Canada, L9H 3B8; Donald G. Coburn, R.R. #3, Collingwood, Ontario, Canada, L9Y 3Z2

[21] Appl. No.: 09/261,486

[22] Filed: Mar. 3, 1999

[51] Int. Cl.[6] ..... A61G 15/00

[52] U.S. Cl. ..... 433/77; 433/79

[58] Field of Search ..... 433/77, 78, 79

[56] References Cited

U.S. PATENT DOCUMENTS 3,514,171 5/1970 McGaha ..... 433/78 X
4,138,815 2/1979 Williams et al. ..... 433/77
4,445,859 5/1984 Haffureister et al. ..... 433/77 X
5,145,366 9/1992 Jarhunen ..... 423/77

*Primary Examiner*—Nicholas D. Lucchesi
*Attorney, Agent, or Firm*—Ingrid Schmidt

[57] ABSTRACT

A method of mounting tools used in dentistry, the tools having flexible tubes associated with instruments remote from the tools, in which a redirector bar is mounted to a bottom surface of a bench top between tool receiving brackets and the instruments so as to support the tubes and define a forward loop and a rearward loop. The tubes in the rearward loop are parallel while the tubes in the forward loop converge when they are extended to the mouth of a patient. Preferably, the tool receiving brackets are supported on the forward edge of a bench top which is slidably mounted for movement in a direction which is parallel to the rearward loop.

6 Claims, 5 Drawing Sheets

METHOD OF MOUNTING TOOL USED IN DENTISTRY

FIELD OF THE INVENTION

This invention relates to tools used in dentistry such as suction tubes, dental drills and other hand pieces which are used to treat patients and particularly relates to a method of mounting these tools so that they are ergonomically positioned in close proximity to the patient and within easy access for the dentist and an assistant.

BACKGROUND OF THE INVENTION

The tools which are used in dentistry commonly have flexible tubes or hoses at one end that are associated with instruments remote from the tools. The hoses carry compressed air and water, for example, in the case of a syringe, and may also include fibre-optic bundles, for example, to provide a light source for a drill bit. It is not uncommon for the dentist and an assistant to require immediate access to as many as six or seven tools, all of which may be required to treat the patient, depending on the nature of the patient's ailment and the procedure which is being used to treat that patient. Typically, the hoses associated with the tools are several feet long and will add considerably to the weight of the tool. This is unnecessarily burdensome and can tire the dentist and impede the manoeuvrability of the tool which is required in the performance of some delicate tasks. One of the contributing factors is that such lengths of hoses often become entangled with adjacent hoses and the selected tool which is in use carries the weight of its own associated hose as well as the weight of other hoses.

An object of this invention is to provide means for mounting these tools used in dentistry so as to alleviate the fatigue experienced by the dentist or an assistant.

SUMMARY OF THE INVENTION

In accordance with the invention, there is provided a method of mounting tools used in dentistry, the tools having flexible tubes at one end associated with instruments remote from the tools, and the tools being removably supported in tool receiving brackets that are supported on a forward edge of a bench top which, in use, is proximate to a patient's head. The method comprises adding tube locating means to a bottom surface of the bench top between the tool receiving brackets and the instruments so as to support the tubes and define a forward loop adjacent to an associated tool and a rearward loop adjacent to an associated instrument so that the weight of the rearward loop is supported by the tube locating means and the tool supports a reduced weight. In a preferred embodiment of the invention, the tube locating means is in the form of a redirector bar that has spaced apertures linearly disposed on a longitudinal axis and which is adapted to receive the tubes in the rearward loop in parallel while directing the tubes in the forward loop so that the tubes will converge when they are extended to the mouth of a patient.

Most preferably, the tool receiving brackets are supported on the forward edge of a bench top which is slidably mounted for movement in a direction which is parallel to the rearward loop and which can be moved so that the forward edge may be positioned relative to the patient's head in accordance with the size of the patient.

Other features of the invention will be apparent from the following description of a preferred embodiment.

BRIEF DESCRIPTION OF THE DRAWINGS

A preferred embodiment of the invention is described below with reference to the accompanying drawings, in which.

DESCRIPTION OF PREFERRED EMBODIMENT

Figure 1:
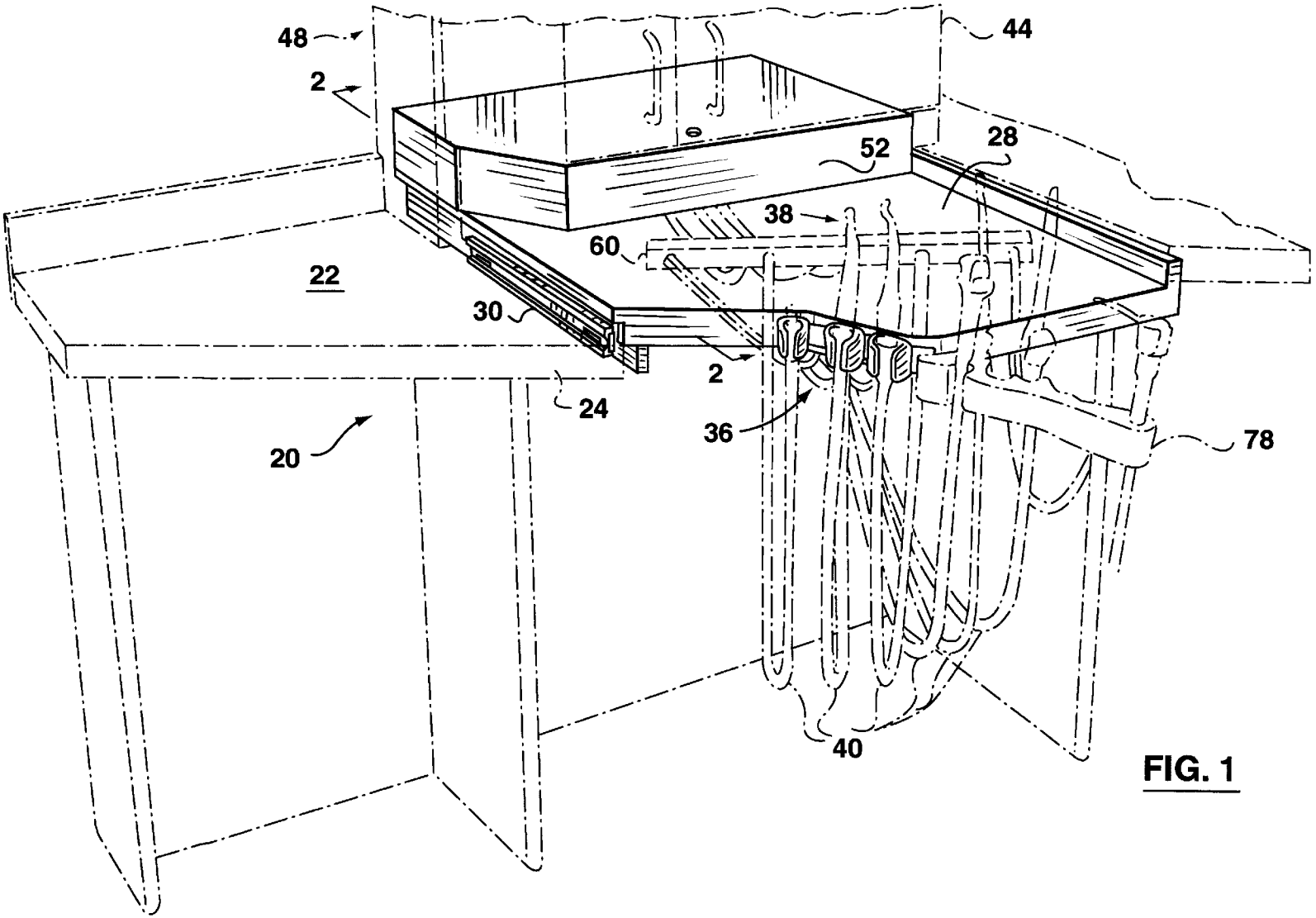
FIG. 1 is a perspective view of a bench top used in a dental office and showing a redirector bar (drawn in a broken line) mounted to the underside of a tray comprising the bench top.

The invention will be described with reference to a custom-built bench top which is generally designated by reference numeral 20 in FIG. 1. The bench top 20 defines counter space for supporting various articles used in dentistry, including tools and patient's charts and also provides a working surface 22 to mix fillers, clean appliances, and make adjustments to these appliances.

Figure 4:
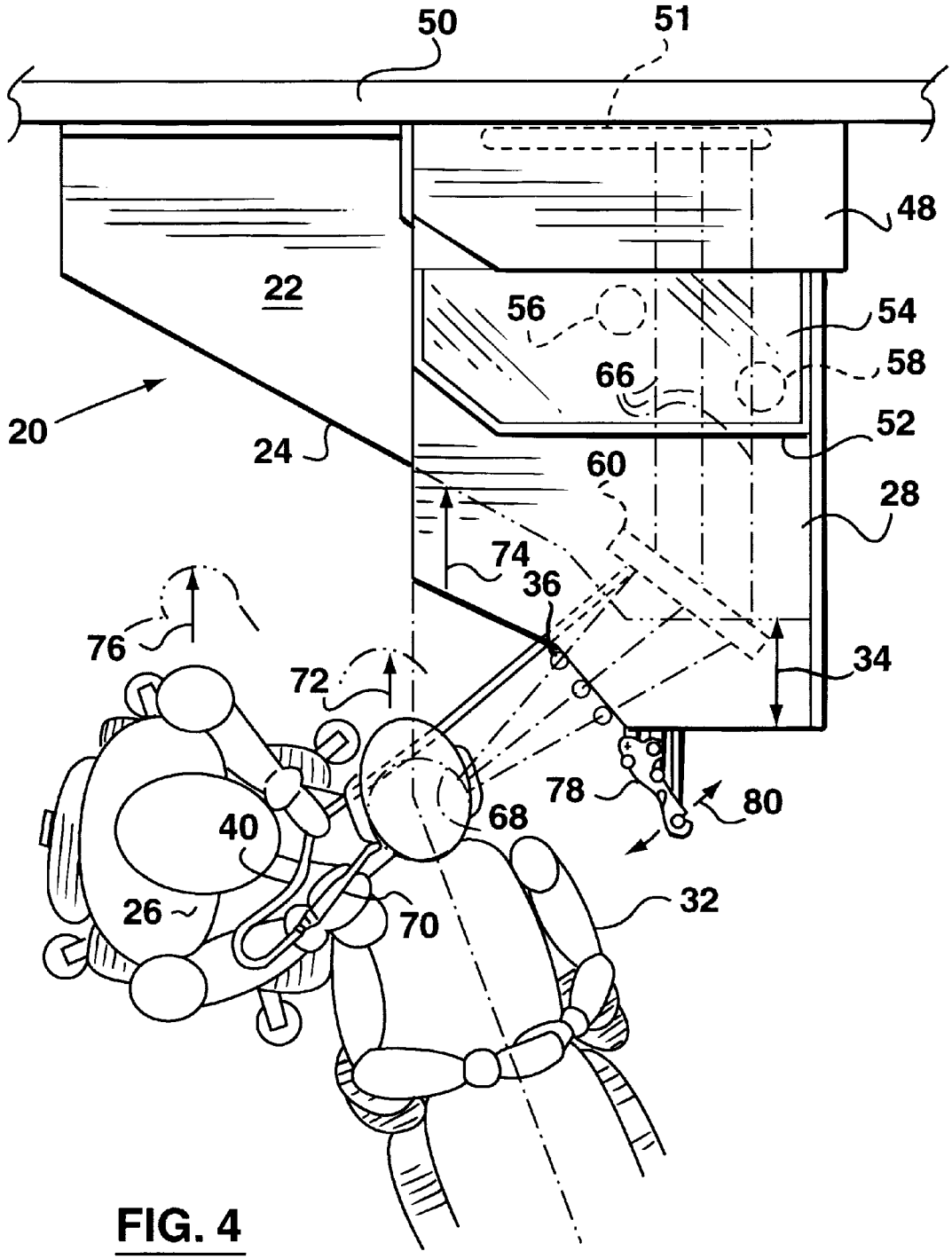
FIG. 4 is a schematic top plan view of the bench top of FIG. 1 showing a patient and a dentist in proximity to the bench top.

The forward edge 24 of the bench top is profiled to allow the dentist and an assistant to have easy access to the working surface 22 and is ergonomically designed to be within arm's reach while the professionals are seated in a working position on opposite sides of the patient. Thus, it will be seen that the working surface 22 adjacent the forward edge 24 which is nearest to a dentist 26 has a greater width than the working surface which is further removed from the dentist (FIG. 4).

A portion of the bench top 20 is defined by a tray 28 which is slidably mounted using slidable guide means 30 disposed on opposite sides of the tray 28 (only one of which is shown in FIG. 1). The tray 28 is adapted to slide towards and away from a patient 32 as indicated generally by directional arrow 34.

Figure 2:
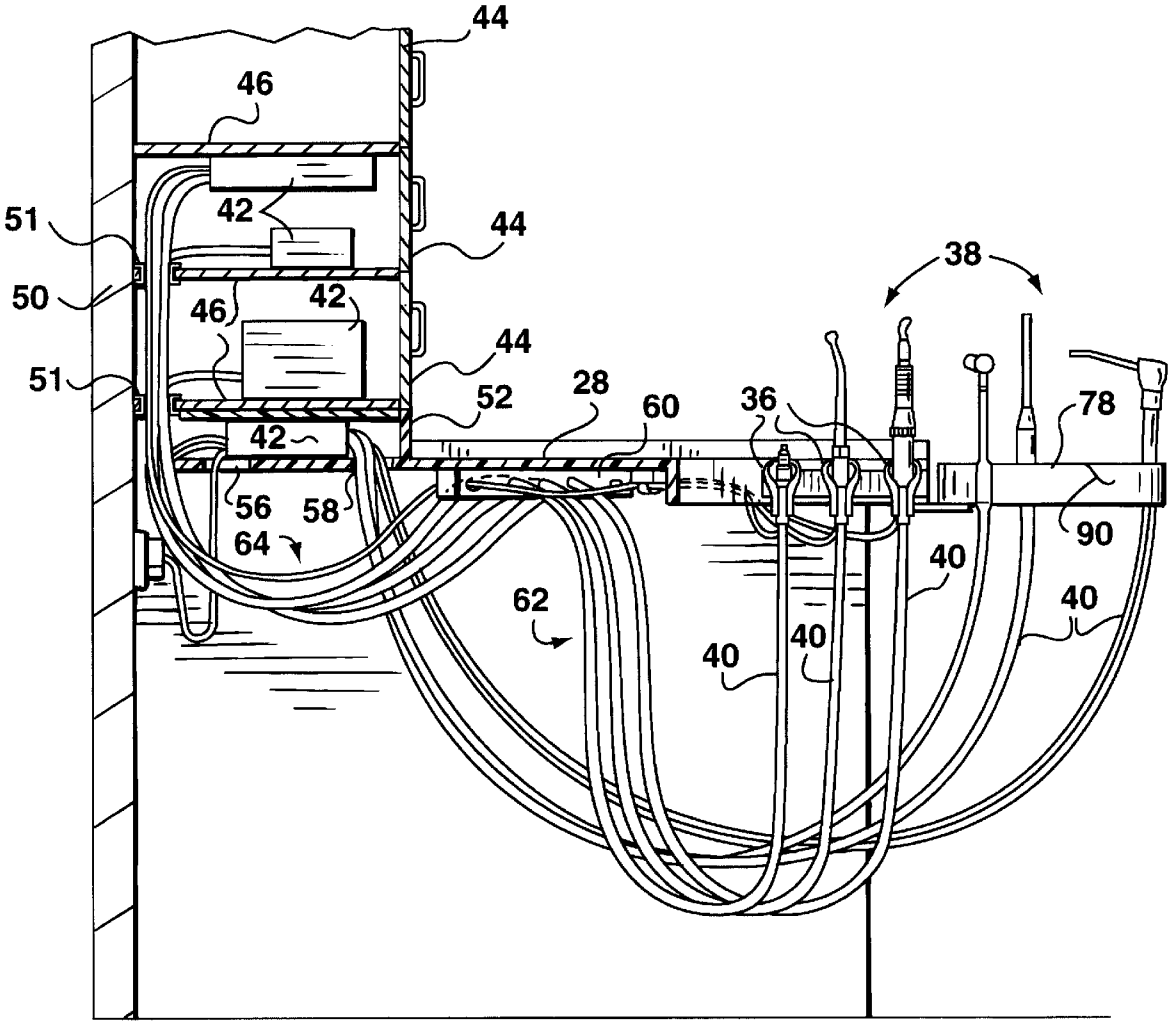
FIG. 2 is a cross-sectional view of the bench top drawn on line 2—2 of FIG. 1.

The forward edge 24 of the tray 28 supports tool receiving brackets 36, 78 which are likewise ergonomically positioned to be within easy reach of both the dentist and the dentist's assistant while being proximate to the patient's head. The tools are generally referred to by reference numeral 38 and are associated with respective flexible tubes or hoses 40 for the supply of compressed air, water, vacuum suction and fibre-optic cables, as the case may be. The tubes are associated with instruments indicated by 42 in FIG. 2 and which conveniently are concealed from view behind cabinet doors 44. The instruments 42 are supported on or from respective shelves 46 provided in a cabinet 48 mounted to a wall 50. Elongated slots 51 are formed in the shelves 46 to receive hoses and cables.

Figure 3:
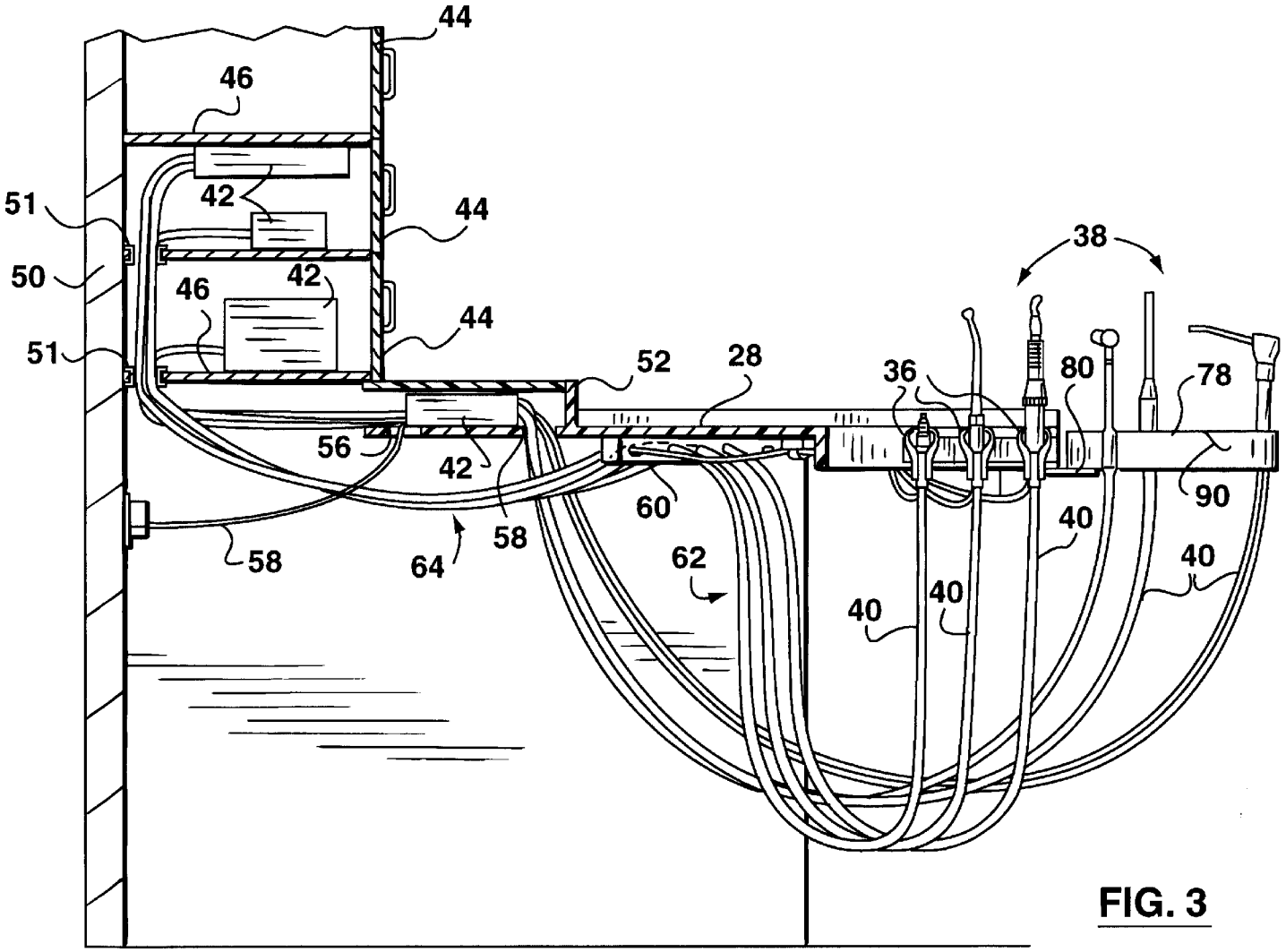
FIG. 3 is a similar view to FIG. 2 with the tray in an extended position.

The lower-most instrument 42 is conveniently supported on a remote portion of the tray 28 which is normally concealed from view in the retracted position of the tray by a vertically-extending trim 52 which is profiled to match the contours of the cabinet 48. The instrument will conveniently move forward with the tray 28 to be more proximate to the patient, as the need arises, so as to minimize the length of tube 40 which might otherwise be required. When the tray 28 is in a forward position as drawn in FIGS. 3 and 4, the area behind the trim 52 becomes exposed and may be accessed through a fitted translucent lid 54. Access holes 56, 57 formed in the rearward portions of the tray 28 are provided to permit access for electrical supply cables 58 and the like.

In accordance with the invention, a redirector bar 60 is mounted to the bottom surface of the tray 28, the redirector bar 60 having a plurality of apertures disposed linearly on a longitudinal axis for the bar 60. The apertures are of a sufficient size to receive the tubes 40 therethrough and the redirector bar 60 supports the tubes on an intermediate portion of the tubes between the instruments 40 and the tools 38. In this way, the tubes 40 are formed into a forward loop 62 and a rearward loop 64, the forward loop being adjacent to the tools 38 and the rearward loop being adjacent to the instruments 42. The apertures in the redirector bar are of sufficient size to permit the tubes to be moved through the aperture so that the length of the forward loop relative to the rearward loop can be adjusted.

It will be appreciated that the redirector bar 60 serves the function of providing additional support for the tubes 40 so that less weight is carried by the tools 38 and this greatly relieves fatigue in the dentist and the dentist's assistant who must use these tools intermittently throughout their working day. The redirector bar 60 also serves to locate the tubes and is positioned so that it is not orthogonal to the direction of travel of the tray 28 which is indicated by directional arrow 34. In this way, the tubes 40 comprising the rearward loop 54 may be received in parallel as indicated in chain dotted lines 66 in FIG. 4 and be directed so that they emerge in the forward loop 62 in a different direction which, when extended through the tool bracket 36, will converge at the mouth of the patient, as indicated by circled area 68. The redirector bar thus functions to locate the tubes 40 so that they are less likely to become entangled during use of any tools 38. During such use, as schematically illustrated in FIG. 4, the tube associated with a selected tool 70 may conveniently be supported across the lap of the dentist, which further reduces the weight in the dentist's hand.

It will be understood that the tray position will be adjusted as required to allow for patients who are somewhat smaller than the average person. Where the patient is tall, the head will be closer to the forward edge 24 of the associated bench top 20, as indicated by arrow 72 in FIG. 4, and the tray can then be returned, as indicated by arrow 74, by sliding it towards the wall 50. The dentist will also adjust his position accordingly, as indicated by arrow 76.

Figure 5:
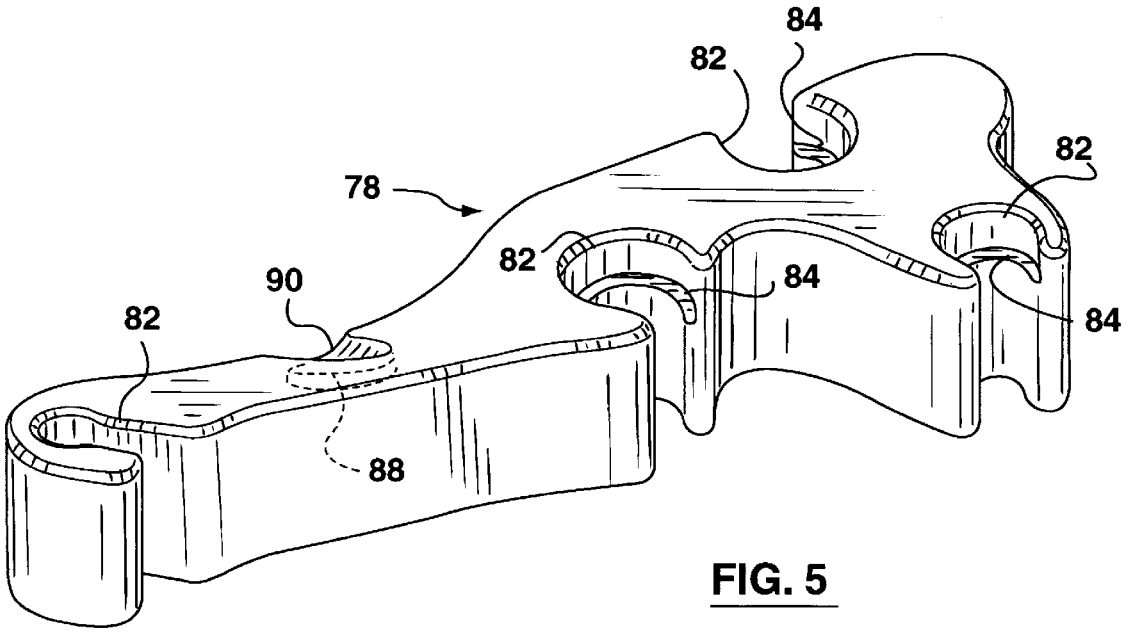
FIG. 5 (drawn to a larger scale) is a perspective view from the top and to the right of a tool bracket.
Figure 6:
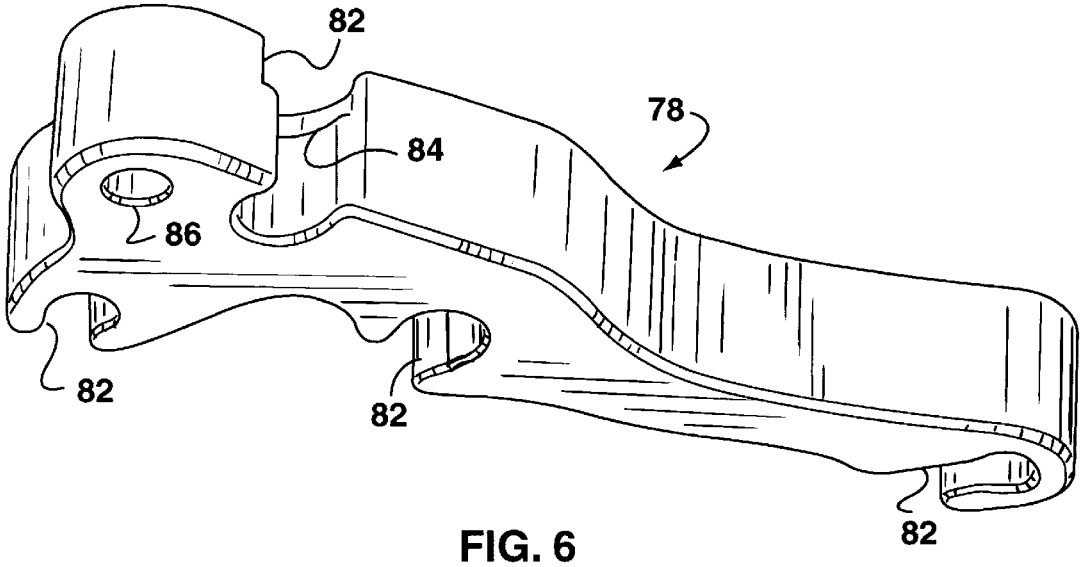
FIG. 6 is a perspective view from the bottom and to the left of the tool bracket of FIG. 5.

An auxiliary tool bracket 78 (FIG. 5) is included in the installation which may be pivoted at one end to have a range of motion as indicated by arrow 80 to position tools required by an assistant so that they are closer to a patient's mouth, as required.

The tool bracket 78 has a unitary body in which are formed a number of tool receiving slots 82 on the peripheral wall, optionally having a shoulder 84 which supports a tool, in use. The shape of the auxiliary tool bracket 78 is the subject of a co-pending design application and its specialized shape is not described further herein. The auxiliary tool bracket 78 has a pivot mount 86 at one end of its elongated body which receives a pivot pin that is secured to the forward edge 24 of the associated tray 28 comprising the bench top 22. At a selected location within the auxiliary tool bracket 78, there is incorporated a magnet 88 which is concealed in the body of the tool bracket beneath a groove 90. The groove 90 is thus adapted to magnetically hold a tool such as a pick or mirror having a steel handle and which may be temporarily rested on the tool bracket.

It will be appreciated that several variations may be made to the components provided to carry out the method in accordance with the invention, as will be apparent to those skilled in the art. In particular, the nature of the tube locating means or redirector bar can be varied considerably. Conveniently, the tray 28 could also take the form of a "stand-alone" trolley or wheeled cart and need not be integrated into a custom-built bench top.

We claim:

1. Method of mounting tools used in dentistry, the tools having flexible tubes at one end associated with instruments remote from the tools, the tools being removably supported in tool receiving brackets supported on a forward edge of a bench top which, in use, is proximate to a patient's head, the method comprising adding tube locating means for locating said flexible tubes, said tube locating means being fixed to a bottom surface of said bench top remote from said forward edge and from said instruments and adapted to support said tubes on an intermediate portion thereof between said instruments and said tools to define a forward loop adjacent to an associated tool and a rearward loop adjacent to an associated instrument, so that the weight of the rearward loop is supported by said tube locating means and the tool supports a reduced weight.

2. Method according to claim 1 in which the tube locating means has a plurality of spaced apertures each adapted to receive a respective tube and to allow the respective tube to move through said aperture so as to adjust the length of a forward loop relative to a rearward loop.

3. Method according to claim 1 in which the tube locating means is in the form of a redirector bar having a longitudinal axis and having a plurality of spaced apertures linearly disposed on said longitudinal axis and adapted to receive the tubes in said rearward loop in parallel, the redirector bar being non-orthogonal to said rearward loop and adapted to direct the tubes in said forward loop so that the tubes may converge when they are extended to the mouth of a patient.

4. Method according to claim 3 in which the bench top is slidably mounted for sliding movement in a direction parallel to said rearward loop so that the position of the forward edge relative to a patient's head may be adjusted in accordance with the size of the patient.

5. Method according to claim 3 in which at least a portion of the forward edge of the bench top and on which the tool receiving brackets are supported is not orthogonal to said sliding movement.

6. Method of mounting tools used in dentistry, the tools having flexible tubes at one end associated with instruments remote from the tools, the tools being removably supported in tool receiving brackets supported on a forward edge of a bench top which, in use, is proximate to a patient's head, the method comprising:

slidably mounting said bench top for sliding movement in a first direction of travel, the forward edge of the bench top on which the tool receiving brackets are supported being non-orthogonal to said sliding movement;

adding tube locating means for locating and redirecting said flexible tubes, said tube locating means being fixed to a bottom surface of said bench top remote from said forward edge and from said instruments and adapted to support said tubes on an intermediate portion thereof between said instruments and said tools to define a forward loop adjacent to an associated tool and a rearward loop adjacent to an associated instrument, the tube locating means having a longitudinal axis and having a plurality of spaced apertures linearly disposed on said longitudinal axis, each adapted to receive a respective tube and to allow the respective tube to move through said aperture so as to adjust the length of a forward loop relative to a rearward loop, the tube locating means being adapted to receive the tubes in said rearward loop in parallel to said first direction of travel, and the tube locating means being non-orthogonal to said direction of travel and adapted to direct the tubes in said forward loop so that the tubes may converge when they are extended to the mouth of a patient.

* * * * *